US008602840B2

(12) United States Patent
Stroppel

(10) Patent No.: US 8,602,840 B2
(45) Date of Patent: Dec. 10, 2013

(54) GRINDING MACHINE COMPRISING TWO SPINDLE SETS

(75) Inventor: Berthold Stroppel, Sigmaringen (DE)

(73) Assignee: Schaudt Mikrosa GmbH, Leipzig (DE)

( * ) Notice: Subject to any disclaimer, the term of this patent is extended or adjusted under 35 U.S.C. 154(b) by 0 days.

(21) Appl. No.: 13/452,490

(22) Filed: Apr. 20, 2012

(65) Prior Publication Data

US 2012/0258648 A1 Oct. 11, 2012

Related U.S. Application Data

(63) Continuation of application No. PCT/EP2010/065467, filed on Oct. 14, 2010.

(30) Foreign Application Priority Data

Oct. 20, 2009 (DE) ..... 20 2009 014 739 U

(51) Int. Cl.
*B24B 19/12* (2006.01)
*B24B 49/12* (2006.01)

(52) U.S. Cl.
USPC ..... 451/6; 451/62; 451/249; 451/251

(58) Field of Classification Search
USPC ..... 451/5, 6, 8, 9, 62, 249, 251
See application file for complete search history.

(56) References Cited

U.S. PATENT DOCUMENTS 4,907,374 A * 3/1990 Brill ..... 451/342
5,259,150 A * 11/1993 Himmelsbach ..... 451/62
5,697,831 A * 12/1997 Reichel ..... 451/246
6,419,563 B1 * 7/2002 Ido et al. ..... 451/57
2008/0014836 A1 * 1/2008 Meusburger et al. ..... 451/5
2011/0009031 A1 1/2011 Honegger et al.

FOREIGN PATENT DOCUMENTS

DE 195 16 711 A1 11/1996
EP 1 088 621 A2 4/2001
GB 2 208 275 A 3/1989
WO WO 2009/023979 A1 2/2009

OTHER PUBLICATIONS

International Search Report WITH Written Opinion of the International Searching Authority, dated Mar. 21, 2011, corresponding to PCT/EP2010/065467, 11 pages.

Studer Schaudt GmbH, "Cam-Grind—Production Solutions for the Grinding of Camshafts," Stuttgart, Oct. 2006, 23 pages.

* cited by examiner

*Primary Examiner* — Robert Rose

(74) *Attorney, Agent, or Firm* — Christie, Parker & Hale, LLP

(57) ABSTRACT

The invention relates to a grinding machine for grinding workpieces, in particular for the simultaneous grinding of two workpieces which are arranged in a tightly adjacent manner. The grinding machine comprises at least two first grinding spindles and at least two second grinding spindles which in each case have a grinding disk receptacle and are mounted pivotably via a support on the spindle block of one of the first grinding spindles, with the result that they can be pivoted about the rotational axis of the respective first grinding spindle.

16 Claims, 10 Drawing Sheets

GRINDING MACHINE COMPRISING TWO SPINDLE SETS

CROSS-REFERENCE TO RELATED APPLICATION

The present application claims the benefit of the earlier filing date of DE 20 2009 014 739.8 filed in the German Patent and Trademark Office on Oct. 20, 2009 and is continuation application of the international patent application PCT/EP 2010/065467 filed on Oct. 14, 2010, the entire content of which applications is incorporated herein by reference.

BACKGROUND

1. Field of the Disclosure

The present invention relates to a grinding machine for grinding workpieces, in particular for the simultaneous grinding independently of one another of two workpieces which are arranged in a tightly adjacent manner, and to a method for grinding workpieces on a holder, in particular for the simultaneous grinding independently of one another of two workpieces which are arranged in a tightly adjacent manner.

2. Description of Related Art

Grinding machines of this type are known, for example, from the brochure "CamGrind—Produktionslösungen für das Schleifen von Nockenwellen" ["CamGrind—production solutions for the grinding of camshafts"] from the firm Studer Schaudt GmbH, Stuttgart from October 2006. Here, for example, the model "CamGrind L" on pages 7 and 16 has a grinding device with two spindle sets which consist in each case of a large and a small grinding disk and are designed, above all, for grinding camshafts. By way of the large grinding disk, first of all the cams are preground here and the bearing seats are machined by means of high power, whereas the small grinding disk serves to grind the cam shapes to a finish or else to grind the bearing seats. In order to machine the camshaft, the latter is arranged on a workpiece holding device which, on one side, has a workpiece spindle head which sets the camshaft in the desired rotation about its longitudinal axis and, on the other side, has a tailstock which ensures that the camshaft is always oriented and centered during the machining. The grinding disks and the corresponding grinding spindles can be moved relative to the camshaft within the x-z plane, with respect to said components of the workpiece holding device which are stationary as a rule. The grinding of the cams directly on the shaft is carried out for the purpose of accuracy, in order that the cams are shaped exactly in relation to the shaft.

When the axes or directions x and z are mentioned in the previous or following text, this always means the two axes which define the plane which forms the machine bed. Here, the z-axis extends parallel to the longitudinal extent of the workpiece, here, for example, of the camshaft, and the x-axis extends as an axis which is perpendicular with respect to the former, which therefore corresponds to a movement of a tool toward or away from the corresponding workpiece from the side. Furthermore, a direction which is perpendicular with respect to the x-axis and z-axis is called the y-axis or y-direction. As a result, it extends perpendicularly with respect to the machine bed.

In order for a selection to be possible between the grinding disks in the grinding machine, the grinding spindle of the small grinding disk is arranged correspondingly on the grinding spindle of the large grinding disk, in such a way that it can be pivoted about the rotational axis of the large grinding disk, or of the corresponding grinding spindle. This principle is already known from DE 195 16 711 A1. The aim here is to achieve a considerable space saving as a result of this spindle set, that is to say by the combination of the large and the small spindle with the corresponding pivoting mechanism.

In the known grinding machines of the series "CamGrind L" which are mentioned in the introduction, this is realized in such a way that the grinding spindles with the small grinding disk are arranged on the spindle block of the large grinding spindle in such a way that the small grinding disk comes to lie approximately 150 mm in the direction of the z-axis behind the large grinding disk.

If a simple grinding spindle set is used which consists of a large and a small grinding spindle, this represents an appropriate arrangement, since the space requirement of the grinding spindle set thus remains as low as possible.

If, however, it is desired to use two grinding spindle sets, as is the case, for example, in the model series "CamGrind L" which is mentioned in the introduction, the problem arises that, in contrast to the large grinding disks, the small grinding disks cannot be moved as closely to one another as desired, with the result that, after positioning of one grinding spindle set and the small grinding disk arranged thereon on a workpiece, there is a corresponding region along said workpiece, which region cannot be reached by the other small grinding disk on the other grinding spindle set. This spacing arises from the positions of the small grinding spindles on the large grinding spindles and would therefore be approximately 300 mm for the model "CamGrind L" which is mentioned in the introduction.

As a result, this mutual impeding of the grinding spindle sets makes more complicated programming of the entire grinding procedure necessary, in order to keep the losses in the efficiency of the grinding machine on account of this impeding as low as possible. Moreover, the time requirement as a result of this mutual impeding is greater than it should be according to expectations when two grinding spindle sets are used. This would ideally be at least half the time as when only one grinding spindle set is used.

Furthermore, it has also been shown, if only one grinding spindle set is used, that, in some positions, the large grinding disk can already collide with the workpiece spindle head or the tailstock when the small grinding disk is to carry out machining and grinding operations which lie very close to the center point of the rotational axis of the workpiece.

SUMMARY

It is an object of the present invention to provide a grinding machine which makes a simpler grinding process possible and can operate more efficiently with respect to the known grinding machines of the type which is mentioned in the introduction.

According to an aspect of the invention, a grinding machine for grinding workpieces, in particular for the simultaneous grinding of two workpieces which are arranged in a tightly adjacent manner, is provided comprising a machine bed, at least two first grinding spindles which can be moved on the machine bed at least in directions which extend substantially parallel to the machine bed and in each case have a grinding disk receptacle and a spindle block, and at least two second grinding spindles which in each case have a grinding disk receptacle and are mounted pivotably via a support on the spindle block of a first grinding spindle, with the result that they can be pivoted about the rotational axis of the respective first grinding spindle. The respective first and second grinding spindles together in each case form a grinding spindle set. The grinding spindle sets are oriented with respect to one another in such a way that the grinding disk receptacles of the grinding spindles of one grinding spindle set and those of the other grinding spindle set point toward one another in a direction which extends substantially parallel to the longitudinal axis of the workpiece. The two grinding spindles of a grinding spindle set are arranged with respect to one another in such a way that grinding disks which can be attached to them lie substantially in a common grinding disk plane which lies perpendicularly with respect to the longitudinal axis of the workpiece and the second grinding spindle can be pivoted between the workpiece and the first grinding spindle in relation to a direction which extends substantially parallel to the machine bed and perpendicularly with respect to the longitudinal axis of the workpiece, grinding disks preferably being arranged in each case on the grinding disk receptacles of the grinding spindles, which grinding disks have a different size, in particular within one grinding spindle set, and are configured in such a way that the grinding disk on the first grinding spindle is larger than the grinding disk on the second grinding spindle.

The arrangement according to the invention of the grinding spindles within a grinding spindle set, or of the grinding disks which are arranged thereon, with the result that the grinding disks lie substantially in a common grinding disk plane which lies perpendicularly with respect to the longitudinal axis of the workpiece, that is to say in a plane which is defined by the x-axis and y-axis, has the advantage that the small grinding spindles of the grinding spindle sets can then also be moved very closely to one another. As a result, with respect to the previous minimum spacing of approximately 300 mm, minimum spacings in the range of magnitude of approximately 10 mm are then possible. In addition to a simplification of the grinding process and its planning, this allows simultaneous grinding of a workpiece pair arranged in a tightly adjacent manner, as is the case, for example, on camshafts in the form of the adjacent cams of a cam pair. The efficiency is therefore increased considerably precisely in this area, that is to say during the grinding of closely adjacent workpiece pairs, since downtimes, in which a grinding spindle set cannot be used on account of mutual impeding, are avoided.

In a further refinement of the invention, the first grinding spindles in each case have a protective cap which is likewise pivoted with the pivoting of the respective second grinding spindle, the respective protective cap preferably being in operative connection with the support. This refinement has the advantage that, as a result of the simultaneous pivoting of the protective cap, the large grinding disk is always protected against grinding materials or detaching materials when the small grinding disk is used, and damage to said large grinding disk is therefore avoided.

In a further refinement of the invention, the grinding spindle sets can be moved and actuated independently of one another on the machine bed. This refinement has the advantage that not only, as described above, is common parallel grinding of, for example, workpiece pairs possible, as they occur on camshafts in the form of the cams, but movement which is, for example, offset or else opposed along and on the workpiece to be ground is also possible, depending on said workpiece. As a result, the flexibility of the grinding machine is again increased considerably, as a result of which it represents an extremely versatile and flexible grinding machine in combination with the features according to the invention which are mentioned in the introduction.

In a further refinement of the invention, the grinding machine has a profile with a grinding region which extends substantially parallel to the rotational axis of the grinding disk, and with at least one profile section which does not extend parallel to the rotational axis of the grinding disk, and has a control unit for controlling the grinding process, the control unit being configured in such a way that the edges of the workpiece are deburred or beveled one after another by way of the at least one profile section of the grinding disk, using positional information of positions of edges of the workpiece in the direction of the longitudinal axis of the workpiece during or after the grinding of the workpiece, in particular toward the end of the grinding of the workpiece.

The combination of the grinding disks which are profiled according to the invention with the control unit according to the invention has the advantage that, during the grinding operation, preferably toward the end of said grinding operation, the corresponding oblique profile section which does not extend parallel to the rotational axis of the grinding disk comes into contact with the edge of the ground workpiece and, depending on the positioning of the grinding disk, removes the burr mechanically from said edge or else bevels the edge of the workpiece. In order to make this possible, the positions of the workpieces and of their edges are determined precisely beforehand, with the result that the orientation of the grinding disks along the workpieces can be set in an optimum manner for said deburring or beveling steps.

This allows the workpiece in this grinding machine according to the invention to be obtained as a product which is ready for packaging. Additional transfer into a further device for removing the burr is not necessary. Said device also makes it possible to already carry out the deburring in the last sections of the grinding process, with the result that the time loss as a result of the deburring is once again minimized. Here, it is then no longer necessary to introduce an extra deburring step, since this is already a constituent part of the entire grinding process.

In a further refinement of the invention, the grinding disk has a roof profile with two profile sections which do not extend parallel to the rotational axis of the grinding disk and between which a grinding region is arranged which extends substantially parallel to the rotational axis of the grinding disk.

Here, "roof profile" is to be understood as a depression in the grinding material, which depression can be seen in the cross section of a grinding disk which cuts the grinding disk in a plane which contains both its rotational axis and a radius. The profile of said depression is such that, as viewed from an edge of the grinding disk, parallel to the rotational axis in the direction of the other edge of the grinding disk, there is a greater radius of the grinding disk in each case at the front and rear than in a region which lies in between, said regions being connected to one another by a transition which does not extend parallel to the rotational axis of the grinding disk, with the result that the cross-sectional profile which results in this way is reminiscent of the shape of a roof.

The provision of the grinding disk with two profile sections which do not extend parallel to the rotational axis of the grinding disk, so that the shape of a roof profile is the result in cross section, has the advantage that therefore two, in particular outer lying, edges of a workpiece, in particular of cams, can be deburred or beveled. To this end, different displacement positions of the grinding disks along the z-axis are necessary, with the result that the first edge can be machined in a first displacement position and the second edge of the workpiece can be machined in a second displacement position. To this end, the control unit is configured in such a way that it sets both one and the other displacement position using the positional information of the positions of the edges of the workpiece for the grinding disk. As a result of the grinding disks with the roof profile and also by way of the control unit according to the invention, both the grinding of a workpiece, in particular of a cam, and the deburring or beveling of two edges of a workpiece can be carried out in one grinding process.

In a further refinement of the invention, the at least one profile section is configured in such a way that the spacing from the rotational axis of the grinding disk of each point in the profile decreases along the extent of the profile section toward the vertex. This refinement has the advantage that that grinding region of the grinding disk which as a rule is arranged in the central region lies closer to the rotational axis than the outer edges of the at least one profile section, with the result that, during the movement of the grinding disk in the direction of the z-axis with simultaneous maintenance of the contact of the grinding region with the workpiece, eventually the at least one profile section comes into contact with the edge of the workpiece to be ground. As a result, said at least one profile section can then remove correspondingly present burr and/or bevel the existing edge of the workpiece.

In a further refinement of the invention, the grinding machine has a data input for receiving the positional information. The provision of a data input by the grinding machine for receiving the positional information has the advantage that it is thus possible to transmit the determined positional data of the workpieces directly into the grinding machine, where said data are then made available automatically to the control unit. Complicated inputting or transmission of the data in some other way is therefore not necessary, as a result of which a higher throughput speed and greater automation are made possible.

In a further refinement of the invention, the grinding machine has a measuring device for determining the positional information. This has the advantage that the workpieces to be machined do not have to be transferred additionally into a separate device, in order to be measured there, whereupon the data then have to be adapted and transmitted. Accordingly, the measuring device is also adapted to the spatial conditions within the grinding machine and is capable of defining the corresponding positions in a form which is suitable therefor.

In a further refinement of the invention, the measuring device is configured for determining the positional information without contact, in particular by spacing determination by means of laser or a proximity switch. This has the advantage that this positional or spacing determination takes place comparatively quickly. In contrast, mechanical sensing of the workpieces would be very slow. Thus, for example, a laser makes it possible to determine all the necessary positional data in the subsecond range, by simple, rapid sweeping or scanning of the workpieces to be machined.

In a further refinement of the invention, the workpieces are received on a holder and the measuring device is configured for determining at least one first position relative to a longitudinal stop of the holder of the workpieces. This is advantageous to the extent that a fixed mechanical reference always exists, against which the workpiece or the workpiece holder can be oriented during clamping into the grinding machine. To this end, said longitudinal stop is attached there, for example, to a fixed mechanically predefined location in the grinding machine, with the result that, as a consequence, the determined positions can also be considered to be the spacing from said fixed mechanical stop in the machine. Further defining of the position of the workpieces within the grinding machine in addition to the relative positional data can be dispensed with, which once again further simplifies the grinding process.

In a further refinement of the invention, the measuring device is configured for determining all positions relative to the longitudinal stop of the holder of the workpieces. This position determination has the advantage for the grinding process that the control unit according to the invention thus has absolute data for all workpieces, with the result that each workpiece can be moved in individually, which increases the flexibility of the grinding machine according to the invention in terms of its possible grinding processes.

In an alternative refinement, the measuring device is configured for determining the remaining positions relative to one another. The relative positional specification is advantageous for the grinding process of the grinding machine according to the invention if the control unit according to the invention actuates the grinding machine or the corresponding grinding disks in such a way that the workpieces are to be machined one after another. To this end, the grinding machine requires data only as it passes from one workpiece to the next. Here, no further calculations are then necessary, with the result that simple displacement of the grinding disks or grinding spindles can take place using the positional data in the form of the relative specifications.

In a further refinement of the invention, the measuring device is arranged outside an interior of the grinding machine. The arrangement, in particular, as a separate device away from the grinding devices has the advantage that the measuring operation for determining the positional information can take place as a time-neutral element in the overall process sequence of grinding. This is due to the fact that the measuring or the determining of the positional information of a workpiece, for example of a camshaft, can take place at the same time as a grinding operation is running within the grinding machine. When this grinding operation is concluded, the workpiece which has already been measured in the meantime can be inserted directly into the grinding machine which is then ready again, and can be ground and machined using the positional information determined in parallel. There is therefore no downtime, in which the grinding machine cannot be active, since a measurement of the workpieces is taking place.

In another refinement of the invention, the measuring device is arranged within an interior of the grinding machine. This has the advantage that there is therefore no additional space requirement outside the machine. Both the measuring device and the grinding machine are arranged in a space in the grinding machine, the measuring device performing, in particular, the determining of the positional information on a workpiece which has already been clamped in the grinding machine. This minimizes the errors which can occur during the transfer of the workpieces from an external measuring device into the grinding machine, since the positional information relate here directly to the position within the grinding machine and are not relative specifications with respect to a defined section of the workpiece which can lead to incorrect positions, for example in the case of faulty insertion into the grinding machine.

In a further refinement of the invention, the control unit is configured in such a way that the edges of the workpiece are deburred or beveled by way of the at least one profile section of the grinding disk only after from 50 to 95%, in particular after from 60 to 80% of the overall machining time. The advantage of this refinement of the control unit according to the invention lies in the fact that thus first of all the general grinding operation can take place by way of the grinding region of the grinding disk, without an additional interaction taking place between the obliquely extending profile sections and the workpiece. An interaction of this type namely also means higher loading for the corresponding obliquely extending profile sections and, as a result, higher material abrasion and wear on the grinding disk. Since an aim of arranging the at least one profile section on the edge of the workpiece to be ground is, in particular, to remove burr which is produced, or to bevel said edge, a relatively short contact is therefore sufficient between the at least one profile section and the corresponding edge of the workpiece.

Accordingly, in the preferred refinement of the grinding disk with the roof profile, the workpiece is preferably first of all positioned in the central region of the grinding disk, that is to say in the grinding region, without an interaction taking place between the obliquely extending profile sections and the edges. The deburring or beveling step therefore advantageously takes place only toward the end of the overall grinding operation. Here, however, it is still a constituent part of the normal grinding operation, since the grinding region continues to remain in contact with the workpiece.

It goes without saying that the features which are mentioned in the above text and those which are still to be explained in the following text can be used not only in the respectively specified combination, but also in other combinations or on their own, without departing from the scope of the present invention.

BRIEF DESCRIPTION OF THE DRAWINGS

In the following text, the invention will be described and explained in greater detail using selected exemplary embodiments in conjunction with the appended drawings, in which.

DESCRIPTION OF THE EMBODIMENTS

Figure 1:
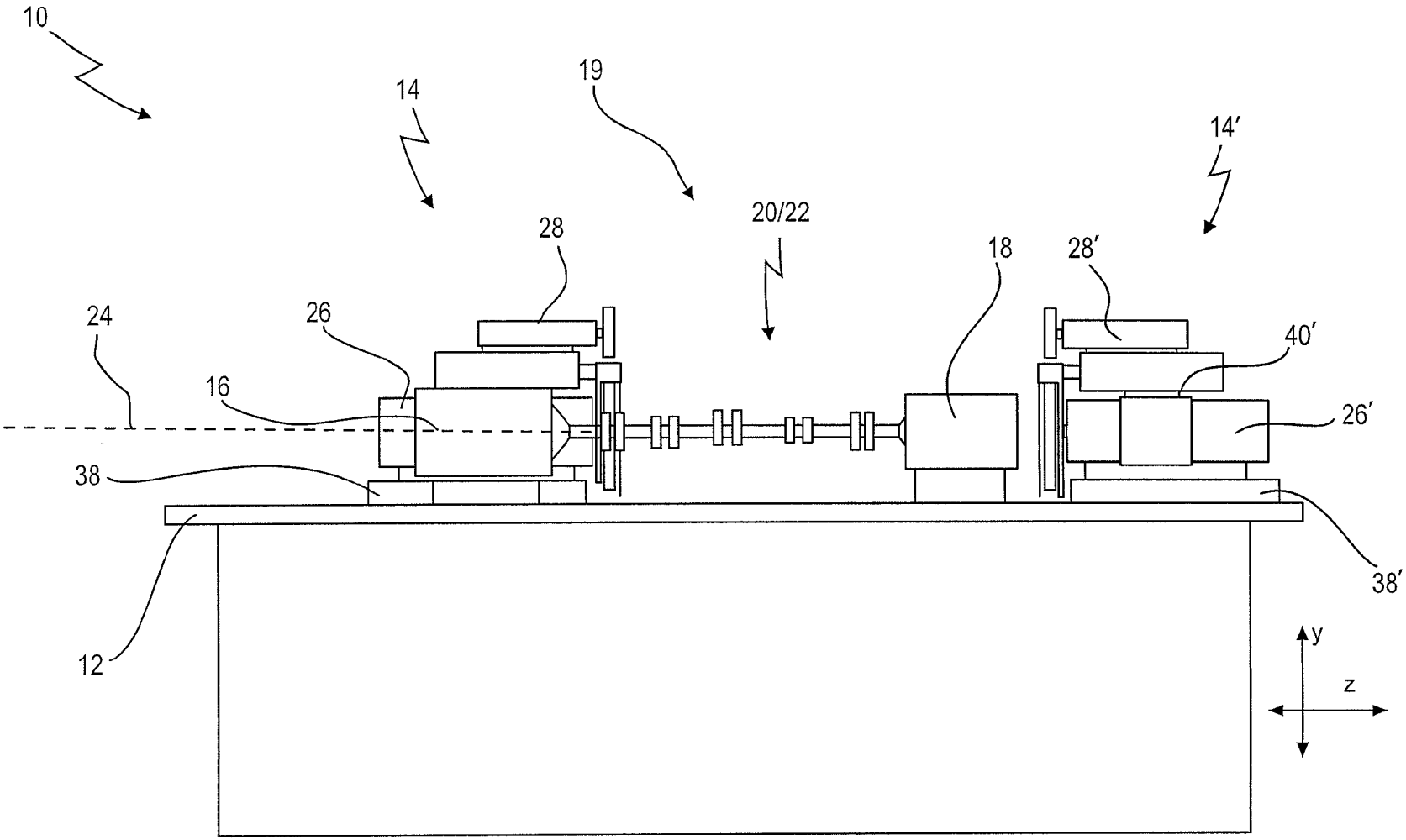
FIG. 1 shows a grinding machine according to the invention in its entirety, as a side view.

A grinding machine which will be described in greater detail in the following text is denoted in its entirety by the designation 10 in the following text. It can be seen in FIG. 1 that the grinding machine 10 has a machine bed 12, two grinding spindle sets 14 and 14', and a workpiece spindle head 16 and a tailstock 18 which are arranged in an interior 19. Here, a workpiece 20 in the form of a camshaft 22 is clamped in between the workpiece spindle head 16 and the tailstock 18.

Said camshaft 22, or in general the workpiece 20, can be rotated about its longitudinal axis 24 by the workpiece spindle head 16 and the tailstock 18 and, during this movement, is machined or ground according to generally known processes by the grinding spindle sets 14 and 14' which can be moved laterally along the x-axis and z-axis.

In the present case, the grinding spindle sets 14 and 14' are both of identical construction. Their respective construction is illustrated by way of example in FIG. 2 using the grinding spindle set 14, but this applies correspondingly to the grinding spindle set 14'.

On account of the identical construction of the grinding spindle set 14 and the grinding spindle set 14', identical designations are used for the constituent parts of the two grinding spindle sets, which designations in each case differ only by way of a prime. Accordingly, even if this is not mentioned explicitly each time, the features for one constituent part of the grinding spindle set 14 likewise apply to the corresponding constituent part of the other grinding spindle set 14' and vice versa, unless something else is stated.

The grinding spindle set 14 consists of a first grinding spindle 26 and a second, in this case smaller, grinding spindle 28. Said grinding spindles consist in each case of a spindle block 30 and 32, respectively, and a grinding disk 34 and 36, respectively, in each case arranged on grinding disk receptacles 35 and 37, respectively, of the grinding spindles 26 and 28, respectively. Here, in the present case, the grinding disk 34 is configured as a large grinding disk and the grinding disk 36 is configured as a comparatively small grinding disk on account of the proportions.

Despite these selected proportions, other proportions are of course also conceivable, with the result that the grinding spindle 28 with the grinding disk 36 can also be configured to be larger than or equally as large as the grinding spindle 26 with the grinding disk 34.

Figure 2:
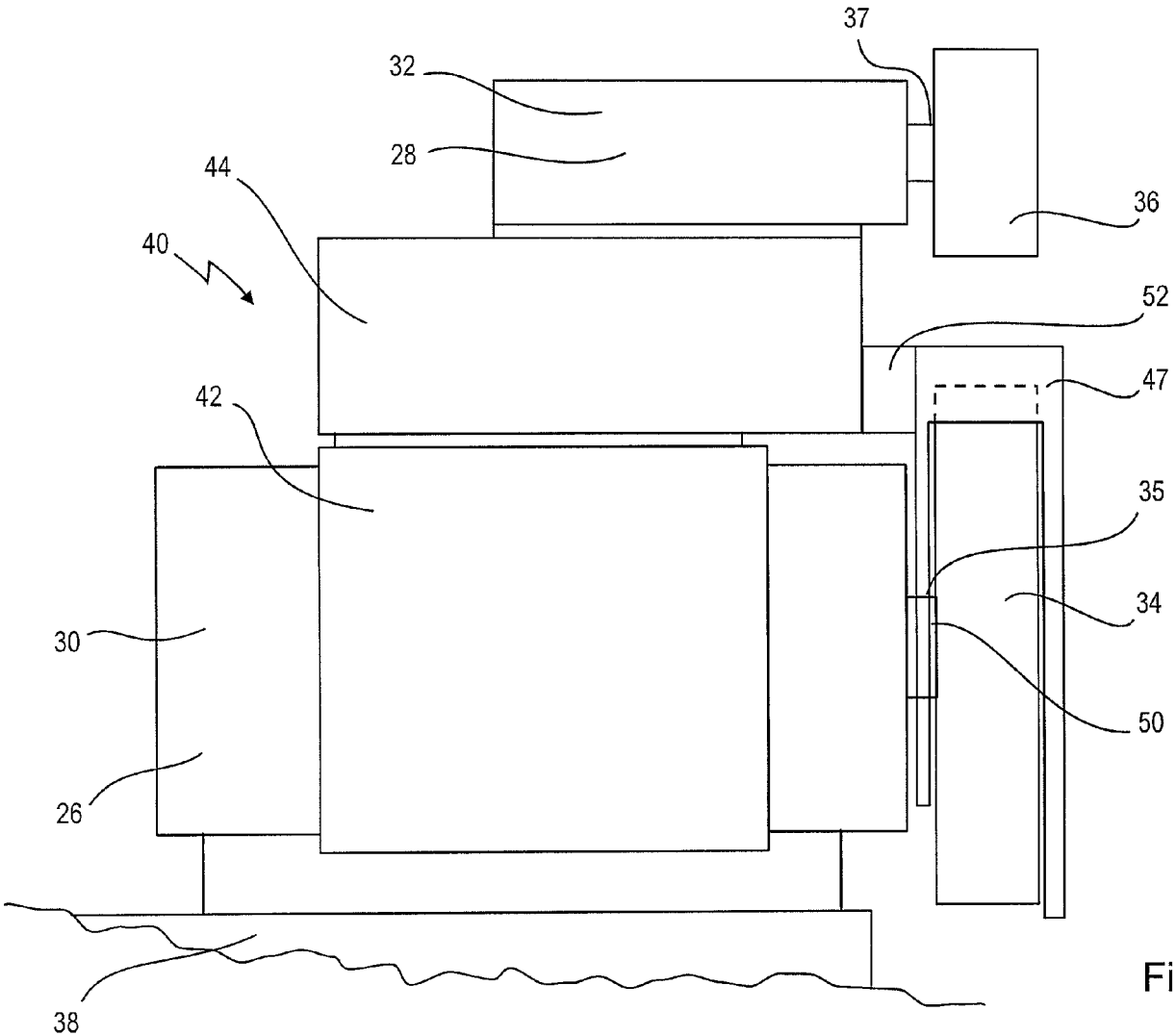
FIG. 2 shows a detailed view of a grinding spindle set according to the invention of the grinding machine from FIG. 1.

The orientation of the grinding spindle 28 in relation to the grinding spindle 26 is such that the grinding disks 36 and 34 come to lie above one another in accordance with the view of FIG. 2, the effect of which in relation to the entire grinding machine 10 is that the two grinding disks 34 and 36 come to lie within a plane which extends perpendicularly with respect to a direction of the z-axis. The grinding spindles 26 and 26' are arranged on a carriage 38 and 38', respectively, which is not shown in greater detail in FIG. 2 but can be seen in FIG. 1, and can be moved on said carriage independently of one another on the machine bed 12 in the x-direction and the z-direction. The grinding spindles 28 and 28' are arranged via a support 40 on the grinding spindle 26 and 26', respectively, on its spindle blocks 30 and 30', respectively, in the case which is shown. As can be seen in FIG. 2, said support 40 has a collar 42 and a holder 44 in this case. The holder 44 serves for direct receiving and fastening of the grinding spindle 28 and therefore arranges the latter on the collar 42. The collar 42 is configured in accordance with the spindle block 30 of the grinding spindle 26, is arranged on said spindle block 30 and is mounted such that it can be pivoted about a rotational axis 46 of the grinding spindle 26.

On account of this refinement, it is possible to pivot the grinding spindle 28 with the grinding disk 36 about the rotational axis 46 of the grinding spindle 26 via the collar 42 and the holder 44. This pivoting takes place by way of a drive unit (not shown in greater detail here) which can be selected, configured and arranged according to the knowledge of a person skilled in the art in this field of grinding machines, in order to obtain a desired functionality of this pivotability. At this point, pneumatic and hydraulic drives or else drives via gearwheels or belts are to be mentioned by way of example.

In order to protect the grinding disk 34, it is provided with a protective cap 47, as can be seen, in particular, in FIG. 2. In the position which is shown in FIG. 2, said protective cap 47 is arranged in such a way that it releases that region of the grinding disk 34 which faces the observer, with the result that a workpiece can be ground which is situated on this side which faces the observer.

The protective cap 47 can likewise be pivoted or rotated about the rotational axis 46 by virtue of the fact that it is mounted rotatably on a pin 50. In order to achieve simultaneous pivoting of the grinding spindle 28 and the protective cap 47, the latter is connected via a web 52 to the support 40, in particular to the holder 44 in the present exemplary embodiment. As a result of this operative connection, if the grinding spindle 28 is pivoted about the rotational axis 46 of the grinding spindle 26, the protective cap 47 is likewise also pivoted, with the result that that region of the grinding disk 34 which faces the observer in FIG. 2 is then covered by the protective cap 47. This can be seen, for example, in the plan view of FIG. 3.

Figure 3:
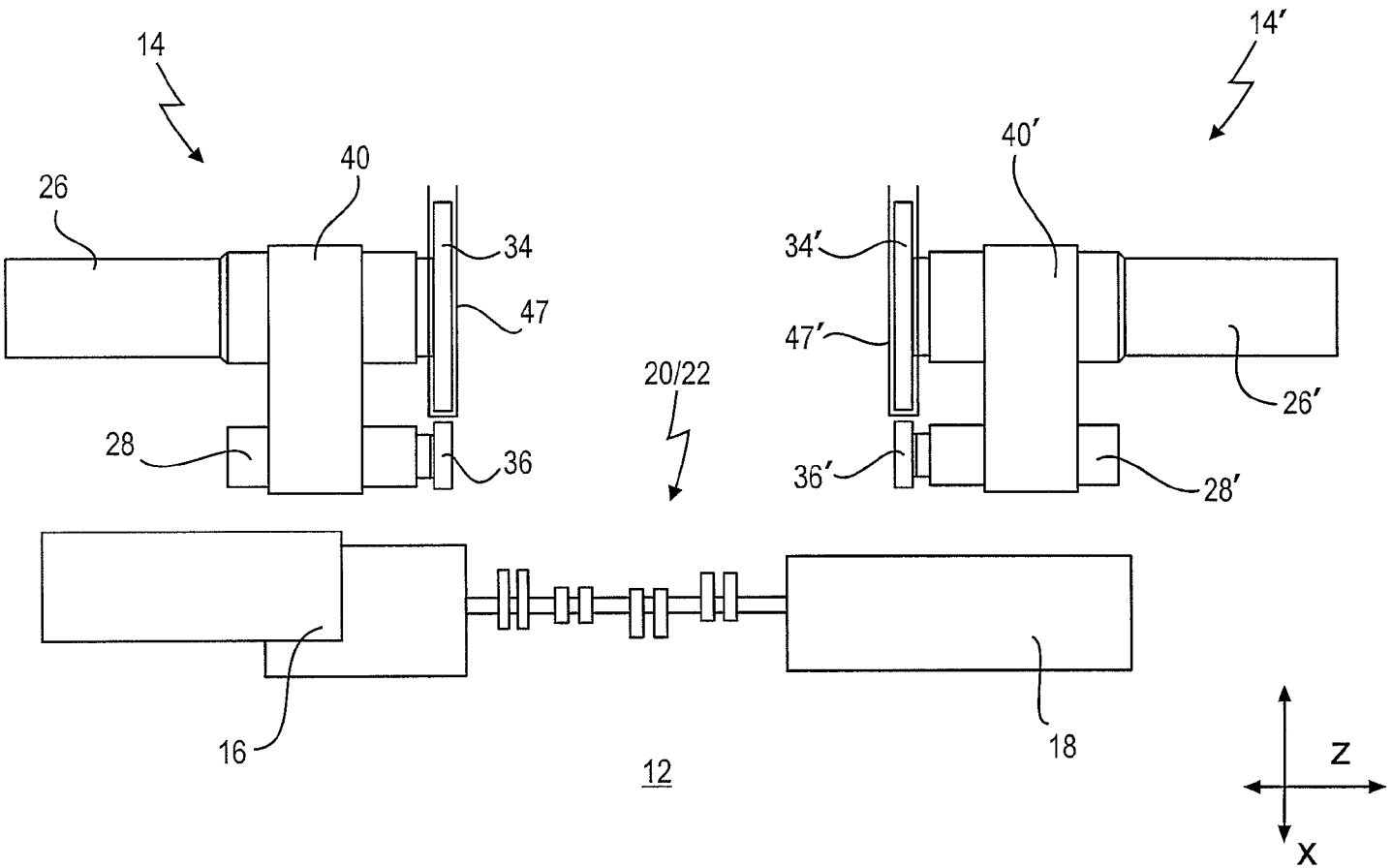
FIG. 3 shows a grinding machine according to the invention in a plan view.

It can likewise be seen in the view from FIG. 3 how the position of the grinding spindle 28 is situated within the entire grinding machine 10 after the pivoting operation. Whereas, in the view from FIG. 1, the position of the grinding spindle 26 and the grinding spindle 28 is such that the grinding disk 34 of the grinding spindle 26 is arranged freely for machining and grinding of the workpieces 20, the grinding disk 36 of the grinding spindle 28 is situated in relation to the direction of the x-axis between the workpiece 20 and the larger grinding disk 34 of the grinding spindle 26 in the position which is shown in FIG. 3. Accordingly, the grinding disk 36 of the grinding spindle 28 is arranged in such a way that it can be used for machining and grinding the workpiece 20, here the camshaft 22.

This arrangement of a large grinding disk 34 for pregrinding a camshaft 22 and a small grinding spindle 28 with the grinding disk 36, which small grinding spindle 28 is arranged pivotably on the grinding spindle 26 of the large grinding disk 34, has the advantage that a considerable space saving is achieved by this combination. The advantages which result from the arrangement of the grinding disks 36 and 34 within the abovementioned common spindle plane which extends perpendicularly with respect to a direction of the z-axis will be described in further detail in the following text.

Figure 4A:
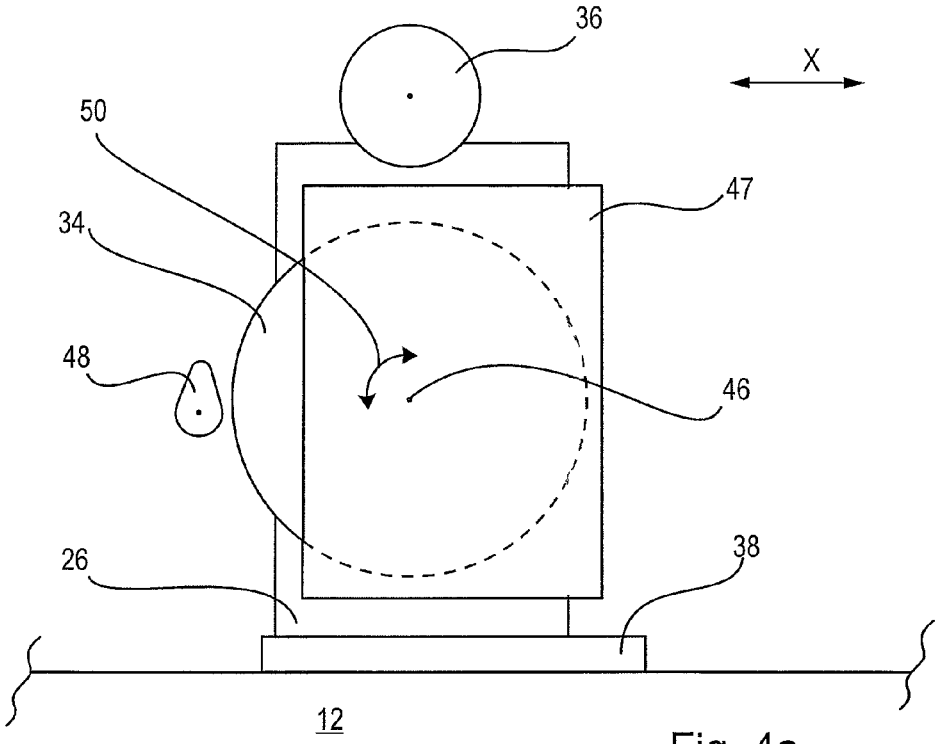
FIGS. 4*a* and 4*b* show a side view of a grinding spindle set according to the invention with the respectively different positions of the grinding spindles.
Figure 4B:
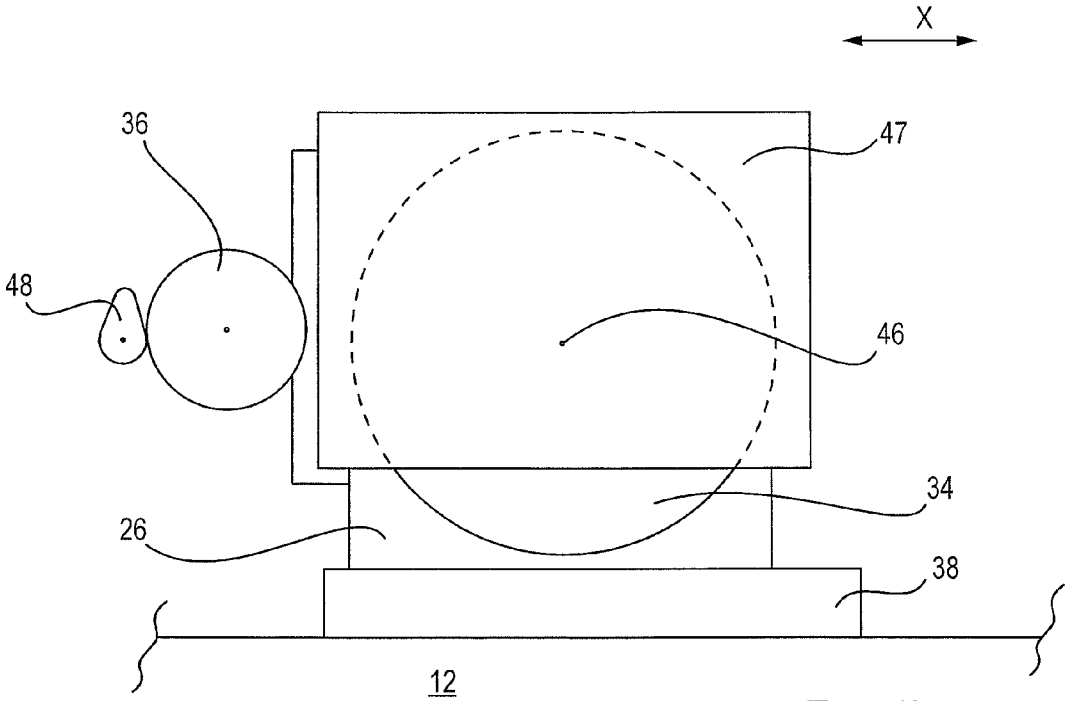

FIGS. 4*a* and 4*b* again illustrate the principle of the pivotable small grinding disk 36 with respect to the large grinding disk 34. Here, FIG. 4*a* shows the state which is also shown in FIG. 1 and FIG. 2 and in which the small grinding disk 36 with the grinding spindle 28 is arranged above the large grinding disk 34 in relation to the views of FIGS. 1, 2, 4*a* and 4*b*. Here, in the right-hand region which is shown in FIG. 4*a*, the large grinding disk 34 is covered by the protective cap 47, but is exposed in the left-hand region, with the result that grinding of workpieces can take place, here, for example, a cam 48 of a camshaft 22. When this pregrinding by way of the large grinding disk 34 is concluded, the grinding spindle set can be moved correspondingly by the carriage 38 in the x-direction, and subsequently a rotation can take place about the rotational axis 46 of the grinding spindle 26, as is indicated here by the double arrow 50.

This rotation ends in the position which is shown in FIG. 4*b* of the small grinding disk 36 and the grinding spindle 28 (not shown here in greater detail) in a position which is on the left next to the large grinding disk 34 in accordance with the illustration of FIG. 4*b*. As a result of rotation of the grinding spindle 28 with the small grinding disk 36, the protective cap 47 is also rotated in this exemplary embodiment, as has already been described above, with the result that that region of the large grinding disk 34 which faces the workpiece 20 is then covered or protected by the protective cap 47. The small grinding disk 36 can thus then carry out the final grinding of the cam 48, while the large grinding disk 34 cannot be damaged by abrasion or sliver materials.

If the large grinding disk 34 is to be used again for grinding operations, it goes without saying that the small grinding disk 36 with the grinding spindle 28 can be pivoted back again in the reverse manner in accordance with what has been said above, with the result that, again in accordance with the pivoting movement, indicated by the double arrow 50, the small grinding disk 36 assumes a position above the large grinding disk 34, as is shown in FIG. 4*a*.

Figure 10A:
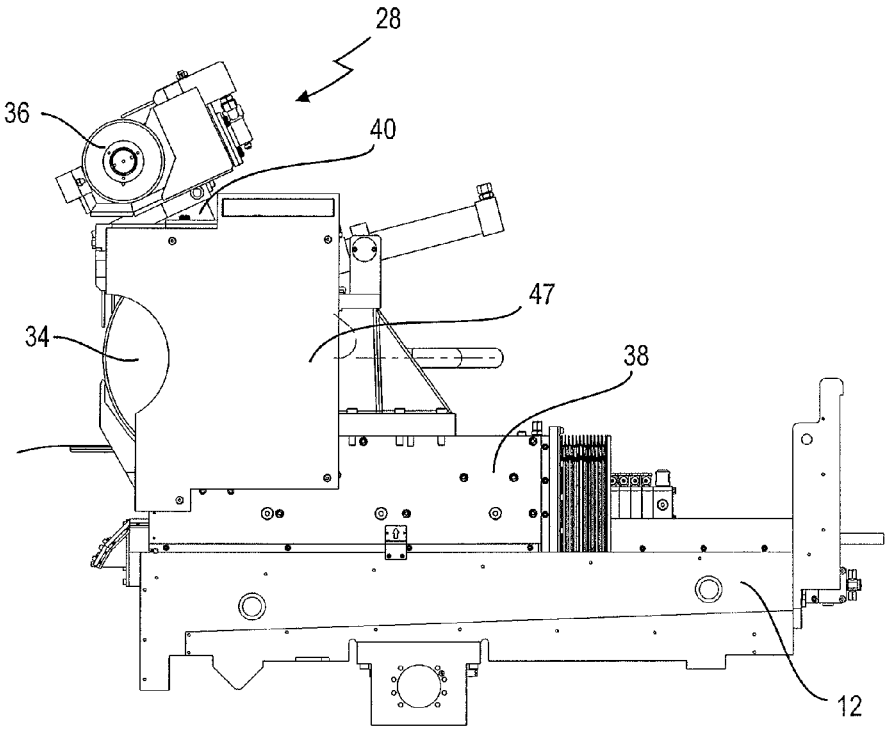
FIGS. 10*a* and 10*b* shows a further side view of a grinding spindle set according to the invention with the respectively different positions of the grinding spindles.
Figure 10B:
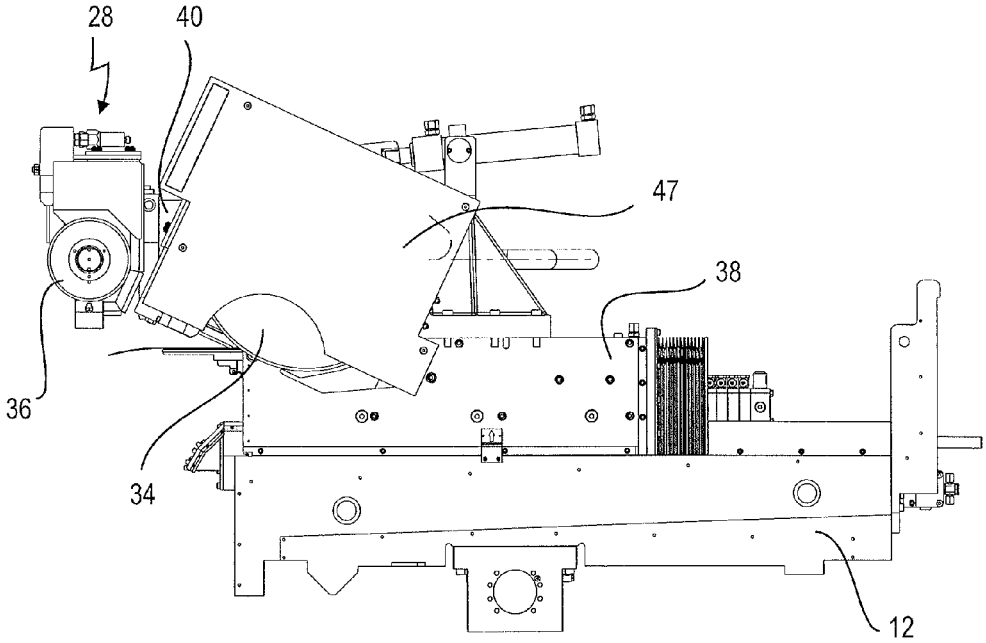

FIGS. 10*a* and 10*b* likewise show a refinement of the grinding machine 10 in accordance with FIGS. 4*a* and 4*b*. Here, in particular, the grinding disks 34 and 36 and the protective cap 47 can also be seen here in their respective positions before and after the pivoting of the grinding spindle 28.

Figure 5:
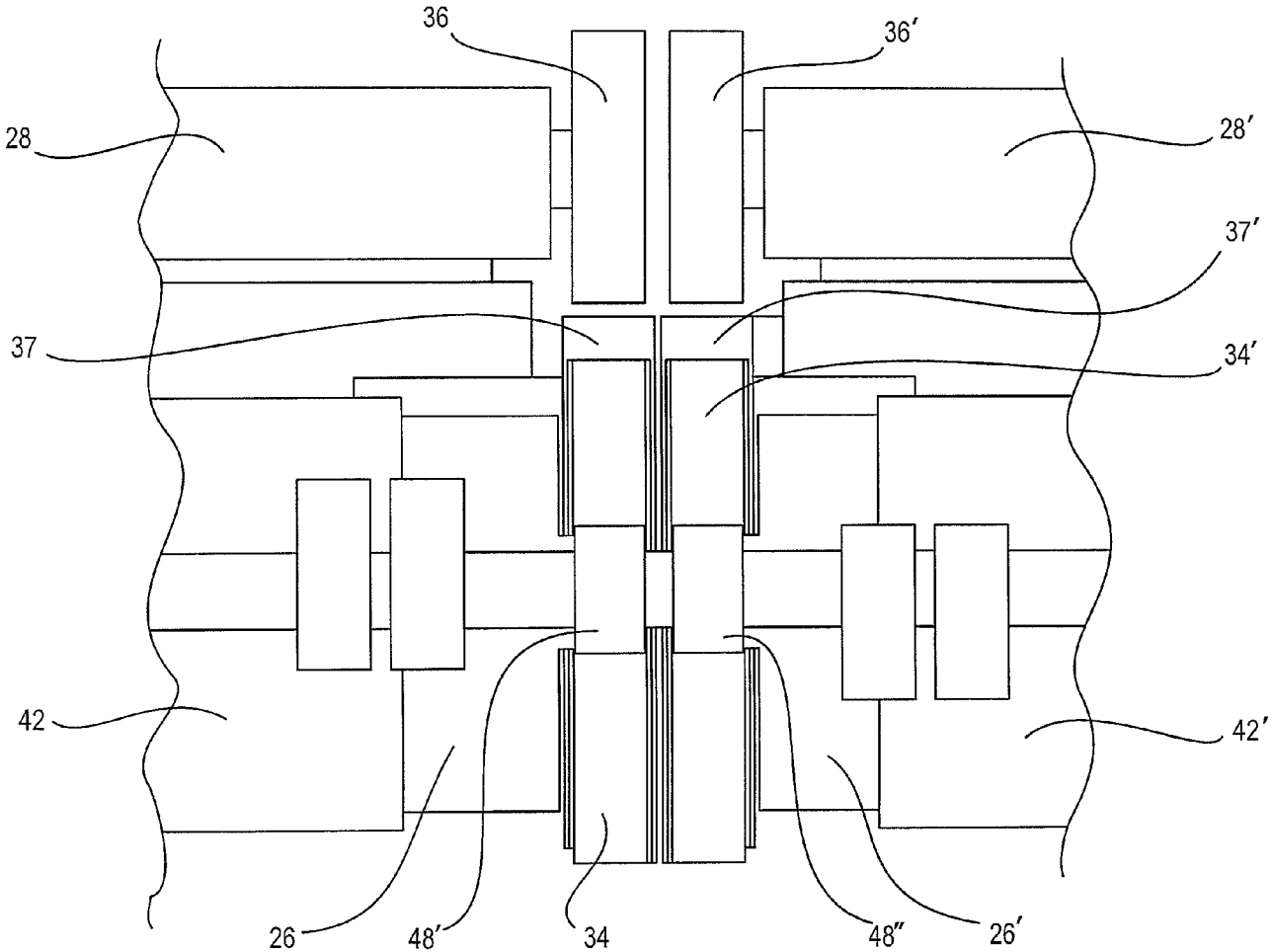
FIG. 5 shows details of a detailed view of the grinding machine according to the invention from FIGS. 1 and 3, in a side view with positioning of the grinding spindle sets which is suitable for pregrinding the workpieces.

As has already been mentioned in the introduction, the grinding machine according to the invention is suitable, in particular, to simultaneously grind or machine workpieces which are arranged in a tightly adjacent manner on a holder, for example the cams 48' and 48" on the camshaft 22 in the exemplary embodiments shown here of FIG. 5 et seq. Here, in each case one of the cams 48' and 48" is machined by a grinding spindle set 14 and 14'.

To this end, the positioning of the grinding spindle sets is shown in the exemplary embodiment of FIG. 5, in which positioning the cams 48' and 48" on the camshaft 22 are preground by way of the large grinding disks 34, 34'. To this end, the grinding spindle sets are moved toward one another in the direction of the z-axis and are oriented at in each case the level of a cam 48', 48" in such a way that the large grinding disks 34, 34' lie opposite in each case one of said cams 48' and 48" in relation to the direction of the z-axis. It goes without saying that, following this or at the same time, an orientation is also performed in relation to the x-axis, in order that the grinding disks 34, 34' can come into corresponding contact with the cams 48', 48", in order for it thus to be possible to carry out a grinding operation in accordance with the known processes. The corresponding orientations within the direction of the x-axis for adaptation to the shape of the workpieces, here of the cams 48 during the rotation of the camshaft 22 about its longitudinal axis 24, also take place according to the generally known processes and by way of corresponding parameters.

During this operation of pregrinding of the cams 48' and 48", the large grinding disks 34 and 34' can move toward one another to as close as a few mm in the direction of the z-axis. As a result, simultaneous pregrinding of this cam pair 52 which is formed from the cams 48' and 48" is made possible. During the above-mentioned moving together in the direction of the z-axis, the minimum spacing between the two grinding disks 34 and 34' is predefined merely by the width of the protective caps 47 and 47'.

If the operation of pregrinding by the large grinding disks 34, 34' is ended, the grinding spindle sets 14 and 14' can be spaced apart from the camshaft 22 in the direction of the x-axis, whereupon the grinding spindles 28 and 28' with the small grinding disks 36 and 36' are pivoted about the rotational axes 46 and 46' of the grinding spindles 26 and 26' in accordance with the comments made above, with the result that the grinding disks 36 and 36' come to lie at a height above the machine bed, or are spaced apart from the latter accordingly, such that the grinding disks 36 and 36' can then be used for machining of the workpieces 20, that is to say of the cams 48' and 48" here.

Here too, a corresponding orientation of the grinding spindle sets 14 and 14' again takes place, that is to say also of the grinding disks 36 and 36', in the direction of the z-axis, with the result that said grinding disks 36 and 36' come to lie relatively close to one another, in order for it to be possible to further machine or grind a corresponding cam pair 52, the cams 48' and 48" here. This positioning is illustrated in FIG. 6.

Figure 6:
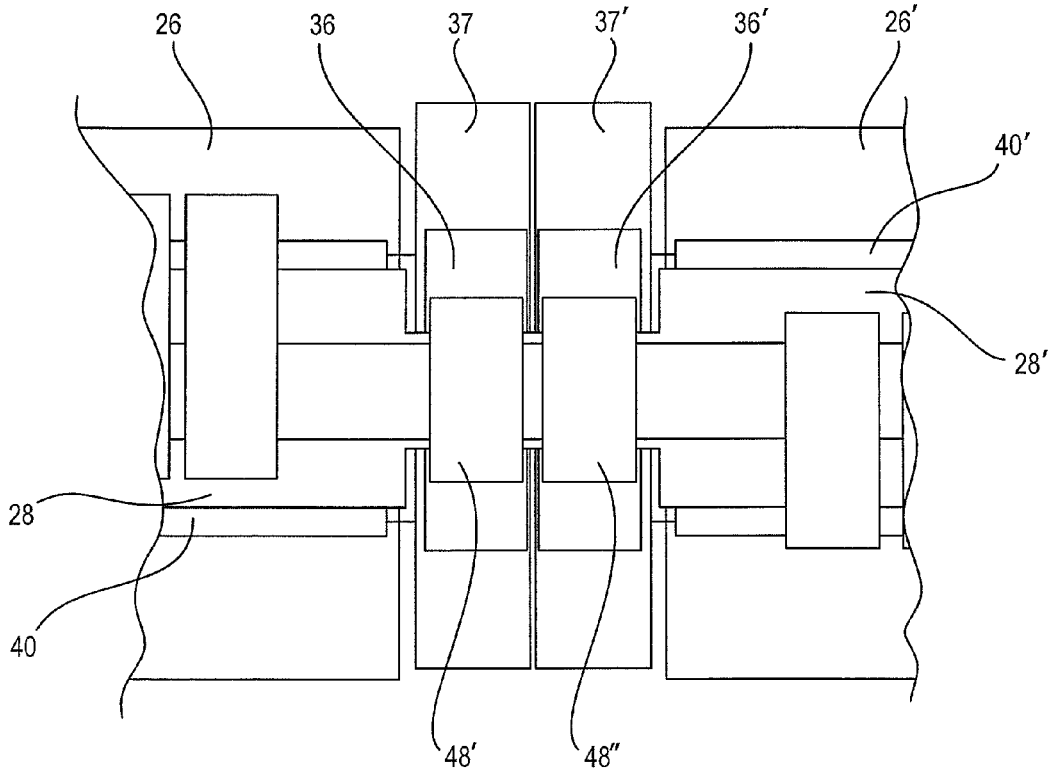
FIG. 6 shows details of a detailed view according to FIG. 5 with positioning of the grinding spindle sets which is suitable for final grinding of the workpieces.

It is seen here that the small grinding disks 36 and 36' come to lie behind the cams 48' and 48" from the viewpoint of the observer of FIG. 6, and the protective caps 47 and 47' can again be seen behind them, which protective caps 47 and 47' cover or protect the grinding disks 34 and 34'. Furthermore, it is also seen that, in comparison with the illustration of FIG. 5, the grinding spindles 28 and 28' then no longer come to lie above the grinding spindles 26 and 26', but rather are arranged between the camshaft 22 and the grinding spindles 26 and 26'.

As a result of this arrangement between the camshaft 22 and the grinding spindles 26 and 26', and with the grinding disks 36 and 36' in a plane which is parallel to the direction of the z-axis, together with the corresponding large grinding disks 34 and 34', it is also possible here to machine a cam pair 52 at the same time.

It goes without saying that the orientation of the grinding spindle sets 14 and 14' also takes place here in the direction of the x-axis according to known processes and by way of corresponding parameters, such that the grinding disks 36 and 36' also always have the necessary and desired contact with the workpieces 20, the cams 48' and 48" here, in order that successful machining and grinding is achieved.

In addition to the exemplary embodiments shown here of FIGS. 1 to 6, in which the grinding spindle sets 14 and 14' are arranged and can be moved on the machine bed 12 on a common side of the workpiece 20 or the camshaft 22, it is of course also conceivable to arrange the grinding spindle sets 14 and 14' movably on different sides of the workpiece 20 or the camshaft 22 in accordance with the knowledge of a person skilled in the art in the field of grinding machines of this type. Furthermore, despite the simultaneous common machining of a cam pair 48', 48" which is shown here, in particular, in conjunction with FIGS. 5 and 6, it is also conceivable that two corresponding cams 48' and 48" or in general workpieces are machined independently of one another.

Figure 7:
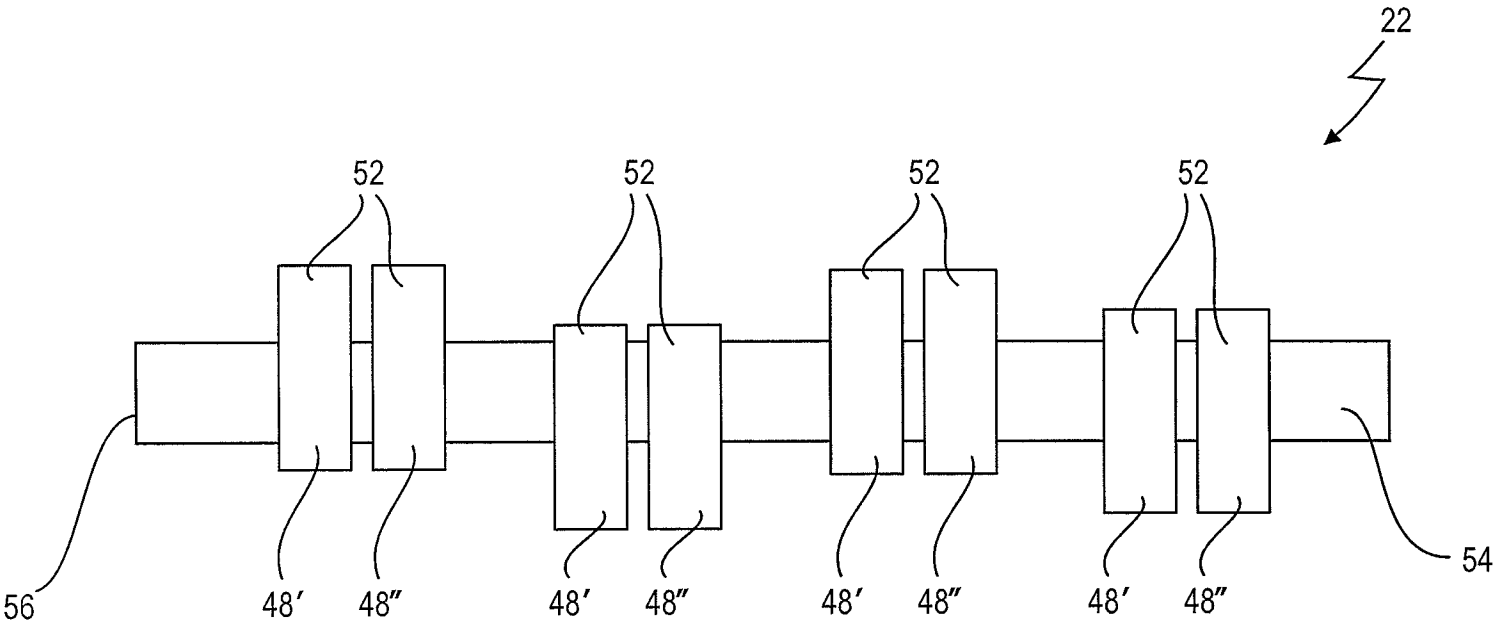
FIG. 7 shows a diagrammatic side view of a camshaft as workpiece of the grinding machine according to the invention.

FIG. 7 shows the diagrammatic construction of a camshaft 22 with the shaft 54, on which the cams 48 are arranged. Of said cams 48, two cams 48' and 48" always form a cam pair 52. Said cam pair is distinguished by the fact that the associated cams 48' and 48" come to lie relatively close to one another, at least closer than the spacing of a cam pair from another cam pair, and that the corresponding cams 48' and 48" within a cam pair 52 of this type are arranged and oriented identically in their arrangement with regard to the rotation about the shaft 54. If said camshaft 22 is inserted into the grinding machine 10, the orientation of the camshaft 22 within the grinding machine 10 takes place in such a way that a longitudinal stop 56 which is inserted, for example, into the workpiece spindle head 16 always assumes the same position within said grinding machine 10.

This orientation by the longitudinal stop 56 can therefore be used to define the position of the cams 48 on the shaft 54 accurately down to a few μm relative to said longitudinal stop 56. Here, this defining can take place in such a way that positional information of the cams 48 is determined which all relates to the longitudinal stop 56, or else in such a way that a corresponding cam 48 is described in its position in such a way that the positional information relates to a preceding cam 48 on the shaft 54. Thus, for example, the position of a cam 48" from FIG. 7 could be described by the spacing from the longitudinal stop 56, or else could be specified as positional information in relation to the preceding cam 48'.

Figure 9:
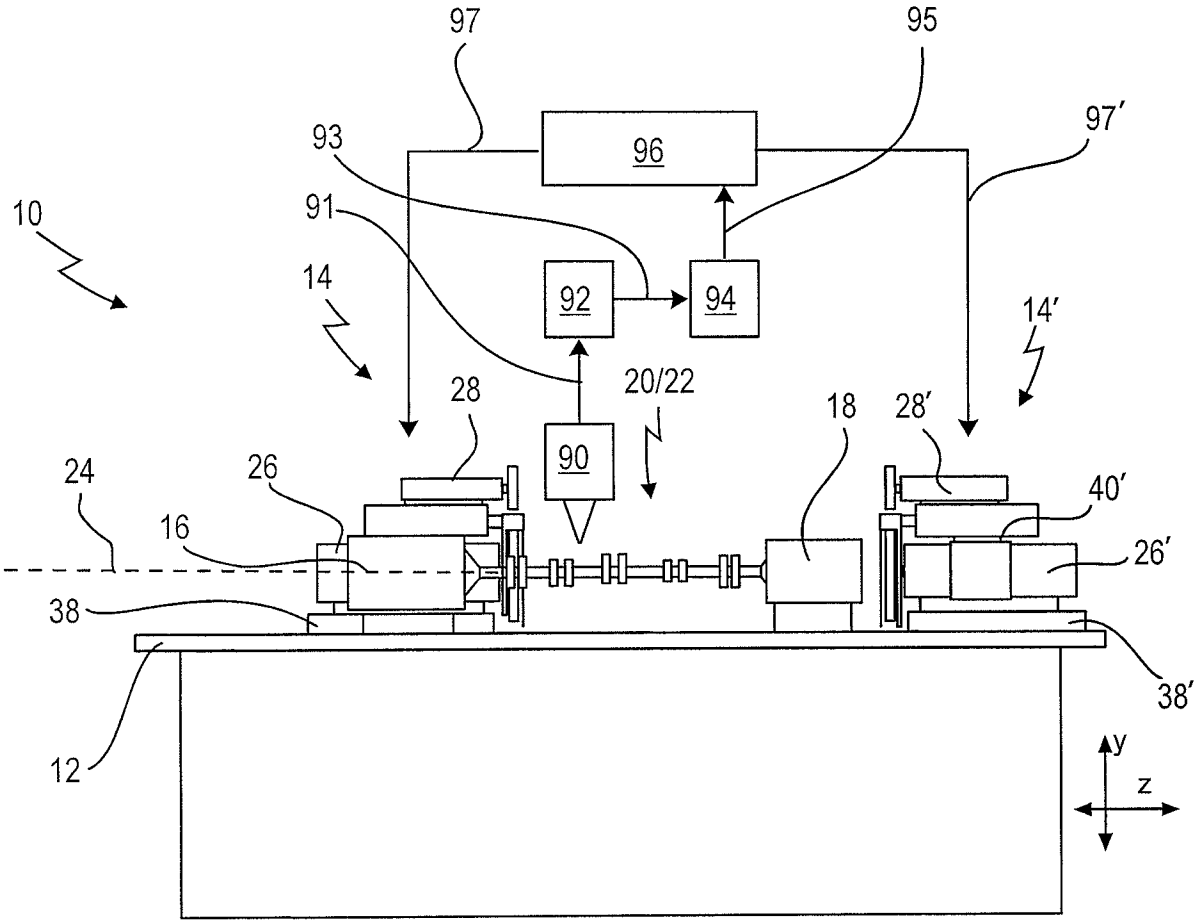
FIG. 9 shows the grinding machine from FIG. 1 with an additional diagrammatic illustration of a measuring device according to the invention, a data input and a control unit.

FIG. 9 shows the devices which are necessary for determining and processing the positional information. The measuring device 90 can be arranged both as a separate device outside the grinding machine 10 and in the interior 19 of the machine, in order to perform the positional determination of the cams 48 there directly on the clamped camshaft 22. The first variant has the advantage that the positions of the cams can be determined while the grinding machine 10 is already being operated with another grinding operation. Downtimes which are caused by the measuring and therefore block the grinding machine 10 for the grinding process are therefore avoided.

In contrast, the other variant of the arrangement of the measuring device 90 within the grinding machine 10 has the advantage that no additional space requirement outside the grinding machine 10 is necessary. Moreover, errors which can occur during clamping of the camshaft 22 into the grinding machine and by way of which a displacement of the previously determined position can occur are avoided.

According to the invention, the determining of the position by the measuring device 90 can preferably take place by way of contactless methods, in particular by way of laser or proximity switches. Moreover, however, other methods known to a person skilled in the art in this field for measuring of workpieces with and without contact, such as mechanical sensing methods, are of course also conceivable.

The data which are determined by the measuring device 90 are forwarded to a data input 92 of the grinding machine 10, as is indicated diagrammatically by the arrow 91. From the data input 92, the data then pass, as indicated diagrammatically by the arrow 93, into a data processing means 94 of the grinding machine 10. The data processing means 94 processes the data in accordance with processes which are known to a person skilled in the art in this field, and subsequently feeds them to a control unit 96, as is indicated by the arrow 95. The control unit 96 serves for direct control of the grinding spindle sets 14 and 14'. This comprises both the movement of the grinding spindle sets 14 and 14' on the machine bed 12 and also, in accordance with the comments made above, the positioning of the grinding spindles 28 and 28' by pivoting, and the operation of the grinding disks 34, 34', 36 and 36'. The control of the grinding spindle sets 14 and 14' by the control unit 96 is indicated diagrammatically in FIG. 9 by the arrows 97 and 97'. In contrast, the arrows 91, 93 and 95 represent the principal course of the positional information in accordance with the comments made above.

The determining of the positional information of the individual cams 48 of the camshaft 22 is firstly of advantage to the extent that, on the basis of said positional information, the grinding spindle sets 14 and 14' can be oriented by a control unit (not shown here in greater detail) in such a way that grinding of the cams 48 can be carried out, as has been indicated, for example, by FIGS. 5 and 6 and has been described in this context. Since the grinding disks cannot be of arbitrary width on account of the grinding disks 34 and 34' or 36 and 36' being moved closely together, which lies in the range of 10 mm, a certain accuracy of the positional information is already necessary here.

Furthermore, deburring or beveling of the workpieces 20, of the cams 48 here, is also made possible on the basis of said exact positional information, as will be described in greater detail in the following text in conjunction with FIGS. 8*a* to 8*c*.

Figure 8A:
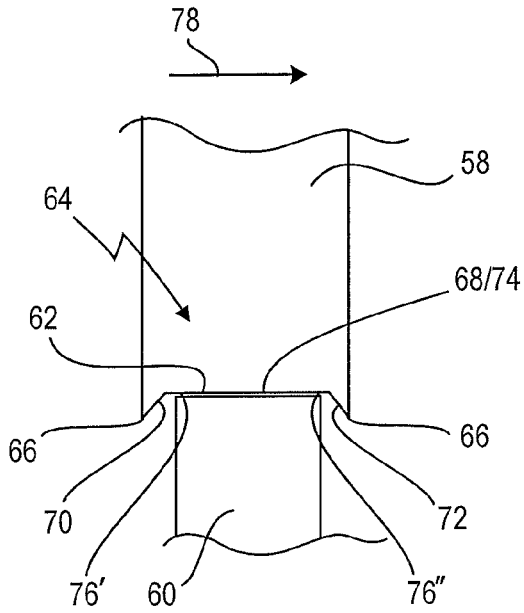
FIGS. 8*a* to 8*c* show details of detailed views of different positions of a small grinding disk with roof profile for deburring or beveling a workpiece.

A grinding disk 58 which represents a special embodiment of the small grinding disks 36 and 36' can be seen in FIG. 8*a*. In order to machine a workpiece 60, for example a cam 48, said grinding disk 58 is oriented on said workpiece 60. As can be seen in FIGS. 8*a* to 8*c*, said grinding disk 58 has what is known as a roof profile 64 in its grinding material 62. Said roof profile 64 is distinguished by a depression in the grinding material 62 in the side which faces the workpiece 60. In relation to the rotational axis (not shown here in greater detail) of the grinding disk 58, this results in circulating grinding faces 66 which lie further on the outside and a circulating grinding face 68 which lies further on the inside. Said grinding faces 66 and 68 are connected to one another, as a transition, by oblique profile sections 70 and 72 which are not oriented parallel to the rotational axis of the grinding disk 58. The result of this offset between the ends 66 and 68 and from the oblique profile sections 70 and 72 is the roof profile 64 which can be seen in the view of FIGS. 8*a* to 8*c*.

Said roof profile 64 therefore has a grinding region 74 as a result of the grinding material 62, which grinding region 74 coincides with the inner end 68, and has those obliquely extending profile sections 70 and 72 which are suitable for deburring and beveling, as will be described in greater detail in the following text.

In addition to the comment made above in relation to the roof profile 64 which can be seen in FIGS. 8*a* to 8*c*, it goes without saying that, here, in the following text and generally in the context of this invention, the expression "roof profile" also means and comprises profiles in grinding disks with only one profile section 70, 72 and also with a grinding region 74 which does not extend parallel to the rotational axis.

If, by way of a grinding disk 58 of this type, the final grinding of a workpiece 60, for example of a cam 48, is to be brought about analogously with respect to the small grinding disks 36, said grinding disk 58 is first of all oriented on the workpiece 60 in such a way that said workpiece 60 is preferably machined exclusively by the grinding region 74. This positioning is shown by way of example in FIG. 8*a*. In order to obtain this positioning successfully, the positional information are used, as has been described in greater detail in the preceding text.

During the grinding operation by way of the grinding region 74, a certain quantity of burr (not shown here in greater detail) is frequently formed at edges 76' and 76" of the workpiece 60.

If the grinding disk 58 is then moved in a direction of the z-axis, shown by way of example here by the arrow 78, the transition from the grinding region 74 to the profile section 70, in the region of a vertex 80, meets the corresponding edge 76' of the workpiece 60, which edge 76' is loaded with burr. This positioning is shown by way of example in FIG. 8*b*. This can take place after the actual grinding process or toward the end of the grinding process, in particular at an instant which corresponds to approximately from 60 to 100% of the total machining time of the individual workpiece.

Accordingly, further grinding by way of the grinding region 74 takes place at the same time as the deburring or beveling of the edge 76' by the profile section 70. After the deburring or beveling operation at the edge 76' has ended, the grinding disk 58 is moved in the opposite direction to previously, which is indicated in FIG. 8*b* by the arrow 82. The end position of this movement along the direction of the arrow 82 is the position shown in FIG. 8*c* of the grinding disk 58 on the workpiece 60, only the edge 76" of the workpiece 60 coming to lie here in the region of the vertex 84 between the grinding region 74 and the profile section 72.

Figure 8B:
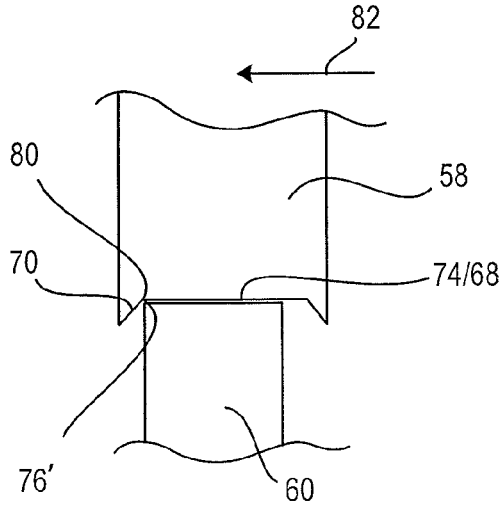
Figure 8C:
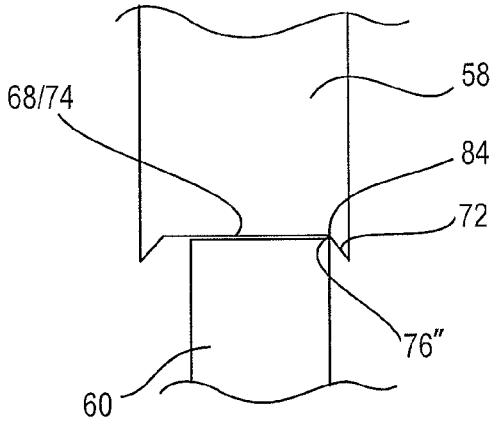

In this positioning of the grinding disk 58 on the workpiece 60, a burr which is formed at the edge 76" is then removed analogously by the profile section 72 of the grinding disk 58, in accordance with the previously made comments in conjunction with FIG. 8*b*. Furthermore, the edge 76" of the workpiece 60 is then also optionally beveled by said profile section 72.

In order for it to be possible to carry out this deburring or beveling exactly, it is necessary that the abovementioned positional information of the workpieces 60, that is to say, for example, the cams 48, is present with accuracy which is as high as possible, since firstly the spacings from the vertices 80 and 84 during the actual grinding operation according to FIG. 8*a* are comparatively low, in order to avoid an unnecessary width of the grinding disk 58. Secondly, beveling of the workpiece 60 at its edges 76' and 76" is often not even to take place, with the result that the arrangement of the profile sections 70 and 72 of the grinding disk 58 on said corresponding edges 76' and 76" of the workpiece 60 is to be performed in such a way that the grinding action of the abovementioned profile sections 70 and 72 is just sufficient for deburring the workpiece 60 at its edges 76' and 76".

It goes without saying that, despite the comments made above, a movement of the grinding disk 58 in the reverse order, that is to say firstly in the direction of the arrow 82 and then in the direction of the arrow 78, also lies in the scope of this invention and leads to identical results in an analogous way.

In accordance with the comments made above in conjunction with, in particular, FIGS. 8*a* to 8*c* and FIG. 9, a method according to the invention for grinding workpieces 60 of this type, in particular cams 48, proceeds in such a way that first of all the positions of the workpieces 60 on a holder (not shown in greater detail in FIGS. 8*a* to 8*c*), for example the shaft 54, are determined. This can take place by way of a measuring device 90. This positional information is then forwarded to the control unit 96 of the grinding machine 10, which controls the grinding process and therefore also the grinding spindles 26, 26', 28 and 28' of the grinding spindle sets 14 and 14'. If necessary, processing and adapting of the positional information by the data processing means 94 can take place beforehand. Based on said positional information, said control unit 96 controls, for example, the grinding spindles 28 and 28', and therefore indirectly the grinding disk 58, or, for example, the grinding disks 36 and 36', toward the workpiece 60 in the direction of the z-axis and also in the direction of the x-axis. As shown in FIG. 8*a*, first of all the workpiece 60 is then ground by the grinding region 74 of the grinding disk 58, whereupon the grinding disk 58 is then moved, in accordance with the comments made above in conjunction with FIGS. 8*b* and 8*c*, in the direction of the z-axis, as is indicated by the arrows 78 and subsequently 82, in order to deburr or bevel the edges 76' and 76" of the workpiece 60. As has already been said, these steps of the movement along the z-axis are based on the exact positional information which was defined in the first step of determining the position of the workpieces 60.

As a result of this method, the deburring and/or beveling can be carried out in a time-neutral manner in the grinding machine 10, as a result of which an additional step, which as a rule requires a further machine, for deburring and/or beveling of the workpieces 60, as has previously been carried out, is dispensed with.

The invention claimed is:

1. A grinding machine for grinding workpieces comprising a machine bed, at least two grinding spindles which can be moved on the machine bed at least in directions which extend substantially parallel to the machine bed and in each case have a grinding disk receptacle and a spindle block, and at least two second grinding spindles which in each case have a grinding disk receptacle and are mounted pivotably via a support on the spindle block of one of the first grinding spindles, with the result that they can be pivoted about the rotational axis of the respective first grinding spindle, wherein the respective first and second grinding spindles together in each case form a grinding spindle set, wherein the grinding spindle sets are oriented with respect to one another in such a way that the grinding disk receptacles of the grinding spindles of one grinding spindle set and those of the other grinding spindle set point toward one another in a direction which extends substantially parallel to the longitudinal axis of the workpiece, wherein the two grinding spindles of each grinding spindle set are arranged with respect to one another in such a way that grinding disks which can be attached to them lie substantially in a common grinding disk plane which lies perpendicularly with respect to the longitudinal axis of the workpiece and the second grinding spindle is pivotable between the workpiece and the first grinding spindle in relation to a direction which extends substantially parallel to the machine bed and perpendicularly with respect to the longitudinal axis of the workpiece, wherein the first grinding spindles in each case comprise a protective cap which is likewise pivotable with the pivoting of the respective second grinding spindle, and wherein the respective protective cap is in operative connection with the support to which the respective second grinding spindle is attached.

2. The grinding machine as claimed in claim 1, wherein grinding disks are arranged in each case on the grinding disk receptacles of the grinding spindles, which grinding disks have a different size within one grinding spindle set and are configured in such a way that the grinding disk on the first grinding spindle is larger than the grinding disk on the second grinding spindle.

3. The grinding machine as claimed in claim 1, wherein the grinding spindle sets can be moved and actuated independently of one another on the machine bed.

4. The grinding machine as claimed in claim 1, wherein a grinding disk has a profile with a grinding region which extends substantially parallel to the rotational axis of the grinding disk, and with at least one profile section which does not extend parallel to the rotational axis of the grinding disk, and further comprising a control unit for controlling the grinding process, the control unit being configured in such a way that the edges of the workpiece are deburred or beveled one after another by way of the at least one profile section of the grinding disk, using positional information of positions of edges of the workpiece in the direction of the longitudinal axis of the workpiece toward the end of the grinding of the workpiece.

5. The grinding machine as claimed in claim 4, wherein the grinding disk has a roof profile with two profile sections which do not extend parallel to the rotational axis of the grinding disk and between which a grinding region is arranged which extends substantially parallel to the rotational axis of the grinding disk.

6. The grinding machine as claimed in claim 4, wherein the at least one profile section is configured in such a way that the spacing from the rotational axis of the grinding disk of each point in the profile decreases along the extent of the profile section toward the vertex.

7. The grinding machine as claimed in claim 4, wherein the grinding machine has a data input for receiving the positional information.

8. The grinding machine as claimed in claim 4, wherein the grinding machine has a measuring device for determining the positional information.

9. The grinding machine as claimed in claim 8, wherein the measuring device is configured for determining the positional information without contact by spacing determinations by means of laser or a proximity switch.

10. The grinding machine as claimed in claim 8, wherein the workpieces are received on a holder, and wherein the measuring device is configured for determining at least one first position relative to a longitudinal stop of the holder of the workpieces.

11. The grinding machine as claimed in claim 10, wherein the measuring device is configured for determining all positions relative to the longitudinal stop of the holder of the workpieces.

12. The grinding machine as claimed in claim 10, wherein the measuring device is configured for determining the remaining positions relative to one another.

13. The grinding machine as claimed in claim 8, wherein the measuring device is arranged outside an interior of the grinding machine.

14. The winding machine as claimed in claim 8, wherein the measuring device is arranged within an interior of the grinding machine.

15. The grinding machine as claimed in claim 4, wherein the control unit is configured in such a way that the edges of the workpiece are deburred or beveled by way of the at least one profile section of the grinding disk only after from 50 to 95% of the overall machining time.

16. The grinding machine as claimed in claim 1, wherein the grinding machine is configured for the simultaneous grinding of two workpieces which are arranged in a tightly adjacent manner.

* * * * *

UNITED STATES PATENT AND TRADEMARK OFFICE

CERTIFICATE OF CORRECTION

PATENT NO. : 8,602,840 B2
APPLICATION NO. : 13/452490
DATED : December 10, 2013
INVENTOR(S) : Berthold Stroppel It is certified that error appears in the above-identified patent and that said Letters Patent is hereby corrected as shown below:

In the Claims

Column 16, Claim 14, line 44 Delete "winding"

Insert -- grinding --

Signed and Sealed this
Seventeenth Day of March, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,602,840 B2
APPLICATION NO. : 13/452490
DATED : December 10, 2013
INVENTOR(S) : Berthold Stroppel It is certified that error appears in the above-identified patent and that said Letters Patent is hereby corrected as shown below:

In the Claims

Column 16, Claim 14, line 42 — Delete "winding"

Insert -- grinding --

Signed and Sealed this
Twenty-fifth Day of August, 2015

Michelle K. Lee

Michelle K. Lee
*Director of the United States Patent and Trademark Office*